US005729616A

United States Patent [19]

Geisenberger

[11] Patent Number: 5,729,616

[45] Date of Patent: Mar. 17, 1998

[54] CENTERING DIAPHRAGM

[75] Inventor: Stefan Geisenberger, Straubing, Germany

[73] Assignee: Nokia Technology GmbH, Pforzheim, Germany

[21] Appl. No.: 447,731

[22] Filed: May 23, 1995

[30] Foreign Application Priority Data

Jun. 1, 1994 [DE] Germany ..... 44 19 311.4
Jun. 18, 1994 [DE] Germany ..... 44 21 418.9

[51] Int. Cl.[6] ..... H04R 25/00
[52] U.S. Cl. ..... 381/197; 181/166
[58] Field of Search ..... 381/158, 185, 381/194, 197, 205, 199, 168–169; 181/166, 171, 144, 146, 149, 151

[56] References Cited

U.S. PATENT DOCUMENTS

| | | | |
|---|---|---|---|
| 1,974,914 | 9/1934 | Gabbert | 179/115.5 |
| 3,925,626 | 12/1975 | Stallings | 181/153 |
| 3,997,739 | 12/1976 | Kishikawa et al. | 381/158 |
| 4,135,206 | 1/1979 | Kleuters et al. | 250/201 |
| 4,235,302 | 11/1980 | Tsukamoto | 181/172 |
| 4,320,263 | 3/1982 | Thiele | 179/115.5 |
| 4,324,312 | 4/1982 | Durbin | 181/171 |
| 4,379,952 | 4/1983 | Kaizer et al. | 381/197 |
| 4,567,327 | 1/1986 | Goossens et al. | 381/185 |
| 4,727,586 | 2/1988 | Johnson | 381/195 |
| 4,807,295 | 2/1989 | Dombroski | 381/199 |
| 4,860,370 | 8/1989 | Grosbard | 381/197 |
| 5,143,169 | 9/1992 | Ziegenberg | 181/144 |
| 5,315,663 | 5/1994 | Thiele | 381/205 |
| 5,323,469 | 6/1994 | Scholz | 381/197 |
| 5,546,470 | 8/1996 | Geisenberger et al. | 381/194 |
| 5,581,624 | 12/1996 | Geisenberger | 381/202 |

FOREIGN PATENT DOCUMENTS

| | | | |
|---|---|---|---|
| 2668018 | 4/1992 | France . | |
| 3037161 | 4/1981 | Germany . | |
| 3609832 | 9/1987 | Germany . | |
| 3620889 | 12/1987 | Germany . | |
| 197808 | 8/1978 | Japan | 181/168 |
| 888337 | 12/1981 | U.S.S.R. . | |
| 1275791 | 12/1986 | U.S.S.R. . | |
| 1760647 | 9/1992 | U.S.S.R. . | |
| 635024 | 3/1950 | United Kingdom . | |
| 1586896 | 3/1981 | United Kingdom . | |

OTHER PUBLICATIONS

Patent Abstracts of Japan 58131897 Aug. 5, 1983 and Japanese Patent Application No. 57014677 Feb. 1, 1982.
Funkschau 1967, vol. 8, 39.Jg., p. 592.
"Die Verfahren der Schweisstechnik", Herhausgeber: Verband fur Schweisstechnik e.V. Dusseldorf,1974, Deutscher Verlag fur Schweisstechnik, 1974.

*Primary Examiner*—Curtis Kuntz
*Assistant Examiner*—Rexford N. Barnie
*Attorney, Agent, or Firm*—Ware, Fressola, Van Der Sluys & Adolphson LLP

[57] ABSTRACT

According to the state of the art, most centering diaphragms (10) for loudspeakers are made of paper, plastic or textile material. These centering diaphragms (10) furthermore have plastic resin coatings. The attachment of the centering diaphragms (10) to the remaining loudspeaker components is mostly made by adhesive bonding. Although such centering diaphragms exhibit good characteristics at low temperatures, they can no longer be used when the ambient temperatures are above 150° degrees Celsius. The invention therefore proposes to make the centering diaphragm (10) for loudspeakers of metal. If the centering diaphragm (10) is subdivided into at least two individual components (10.1 to 10.4), these individual components (10.1 to 10.4) can be used as contact bridges between the wire ends (28) from the voice coil (24) and the audio signal line (30). If the respective surfaces in the connection areas of the individual components (10.1 to 10.4) and the remaining loudspeaker components (15, 20) are made of aluminum for example, the individual components (10.1 to 10.4), or the centering diaphragm (10), can very easily be joined to the remaining loudspeaker components (15, 20) by ultrasonic welding.

10 Claims, 4 Drawing Sheets

CENTERING DIAPHRAGM

TECHNICAL FIELD

The invention concerns the formation of centering diaphragms or spiders for loudspeakers.

BACKGROUND OF THE INVENTION

According to the state of the art, centering diaphragms are used to radially support the oscillating components of the loudspeaker. In general, it is a circular disk with a wave-shaped cross section. The inside edge of the centering diaphragm is connected to the oscillating components of the loudspeaker. Depending on the loudspeaker construction, the oscillating components can either be the loudspeaker diaphragm, the so-called voice coil support, or even the voice coil itself. The outer edge of the centering diaphragm is connected to the loudspeaker frame.

Centering diaphragms must fulfill the following requirements, so that the oscillating components of the loudspeaker are not influenced by the centering diaphragm, or as little as possible.

On the one hand, the centering diaphragm being used must present very little resistance (stiffness) to the excursion movement of the oscillating components in the axial direction, but at the same time prevent any radial movements of the oscillating components.

On the other, the resistance of the centering diaphragms in the axial direction must be the same over the entire excursion movement of the oscillating components.

Furthermore, the centering diaphragm being used must be constructed so as to protect the air gap in the magnet system from contamination. In most instances the latter is solved by enclosing the centering diaphragm, the voice coil support, the surface of the magnet system and areas of the loudspeaker frame inside a space. However, since such a closed air space acts as a damper, the centering diaphragm has perforations.

The materials that fulfill all of the above cited characteristics and can be used as centering diaphragm materials are paper, plastic or textile materials. Depending on the application, these materials can also be in the form of fabrics and have a resin or plastic coating.

As a rule, the edge areas of the centering diaphragm are cemented to the other components of the loudspeaker.

Although such configurations of centering diaphragms have produced satisfactory results in the past, it is considered a disadvantage that such centering diaphragms are only temperature-resistant to about 120° C. The lack of temperature resistance manifests itself above all in that the centering diaphragm begins to soften and loses its original shape at about 120° C. In addition, at temperatures above 120° C. and continuous mechanical stress, the cemented connections between centering diaphragm and the other loudspeaker components have no long-term life expectancy. At about 150° C., the (plastic) coatings on the surface of the centering diaphragm are no longer stable. The endurance of the cemented connections can easily be improved with the use of high-quality adhesives. However, this improvement requires the use of toxic adhesives, which is no longer tolerated under the present environmental points of view. The use of high-quality fabric materials also improves the operating temperature. However, the plastic impregnation is essentially restricted to the operating temperature of the centering diaphragm, so that altogether no satisfactory results can be expected at temperatures above 150° C. and continuous mechanical stress.

For that reason the invention has the task of presenting a centering diaphragm for loudspeakers, which can also be used at sustained temperatures above 150 degrees Celsius.

SUMMARY OF THE INVENTION

This task is fulfilled by a centering diaphragm for loudspeakers, characterized in that the centering diaphragm is made of a nonmagnetic metal, and that means are provided to enable the exchange of air between the areas above and below the centering diaphragm. Advantageous developments of the invention can be found in the subclaims.

If the centering diaphragm is made of non-magnetic metal, there are no problems regarding the temperature resistance of this component in the desired temperature range. Any misgivings regarding the damping effect of metal centering diaphragms are easily regulated with the thickness of the metal diaphragm. This can mean for example that the thickness of the centering diaphragm can also be made non-uniform in the radial direction of the loudspeaker axis. Furthermore, the resistance effect of a metal diaphragm produced by a deep-draw process, for example, can be affected by full or partial area hardening. Without being restricted to this material, copper-beryllium alloys have proved to be very suitable alloys for the production of metal centering diaphragms.

If the centering diaphragm itself is provided with openings, an unrestricted exchange of air takes place between the space enclosed by the centering diaphragm, the voice coil support and the loudspeaker frame, and the area above the centering diaphragm. This construction of the centering diaphragm, which can also be found in conventional centering diaphragms, has the additional advantage in metal centering diaphragms that modifying the size, shape and arrangement of these openings provides further possibilities for adjusting the resistance of the centering diaphragm to the oscillating components of the loudspeaker. In addition, such openings are very easy to produce with stamping processes. Metal wire mesh can also be used to produce metal centering diaphragms. If the openings in the centering diaphragm for adjusting the resistance to the oscillating components of the loudspeaker are so large that they provide no protective function for the air gap, it may become necessary to cover the openings in the loudspeaker frame with a fine-meshed grid or fabric, to prevent dust from penetrating into the air gap.

The connection of the metal centering diaphragms to the other components of the loudspeaker is particularly simple, if the respective edge areas of the centering diaphragm and the connection areas of the other components are made of an ultrasonically weldable metal, at least at their connection surfaces. In that case the respective parts can very easily be joined by using ultrasonic welding technology.

If the voice coil is entirely made of an ultrasonically weldable metal, perhaps as a separate component of the loudspeaker, the production of the voice coil and centering diaphragm connection is further simplified, since the coating of the component part of the loudspeaker being connected can be omitted. It should furthermore be pointed out that the same advantage is achieved if the centering diaphragm is connected to a different component of the loudspeaker made entirely of aluminum (perhaps the loudspeaker diaphragm or the loudspeaker frame). Since the edge attachment of the centering diaphragm to the loudspeaker frame is not subject to limitations with respect to weight of the connection, by contrast to the edge attachment of the centering diaphragm to the respective oscillating component of the loudspeaker, the edge attachment between centering diaphragm and loudspeaker frame can also be accomplished with rivets or screws.

If the openings in the centering diaphragm are at least partially formed so that the centering diaphragm is divided into two independent not connected parts, the resulting and electrically nonconducting edge parts, which are connected to the other components of the loudspeaker, can be used as conductors for the electrical connection of the voice coil wire ends to the wire ends of the audio signal line.

Even when individual insulated parts are used, the connection technique need not to be omitted. If a layer of insulation is used as the insulator, which is copper-coated for example on two facing and not connected surfaces, each of these surfaces can be connected to another component of the loudspeaker (for example to the voice coil support and the centering diaphragm) by ultrasonic welding, as long as the touching surfaces of the other components are also made of an ultrasonically weldable metal.

The connection of the respective wire ends of the voice coil and audio signal line to the individual insulated parts is further simplified if the individual parts have an ultrasonically weldable metal on their contacting surfaces. In that case, the copper wire ends can also securely contact the individual parts through ultrasonic welding.

BEST MODE FOR CARRYING OUT THE INVENTION

Figure 1:
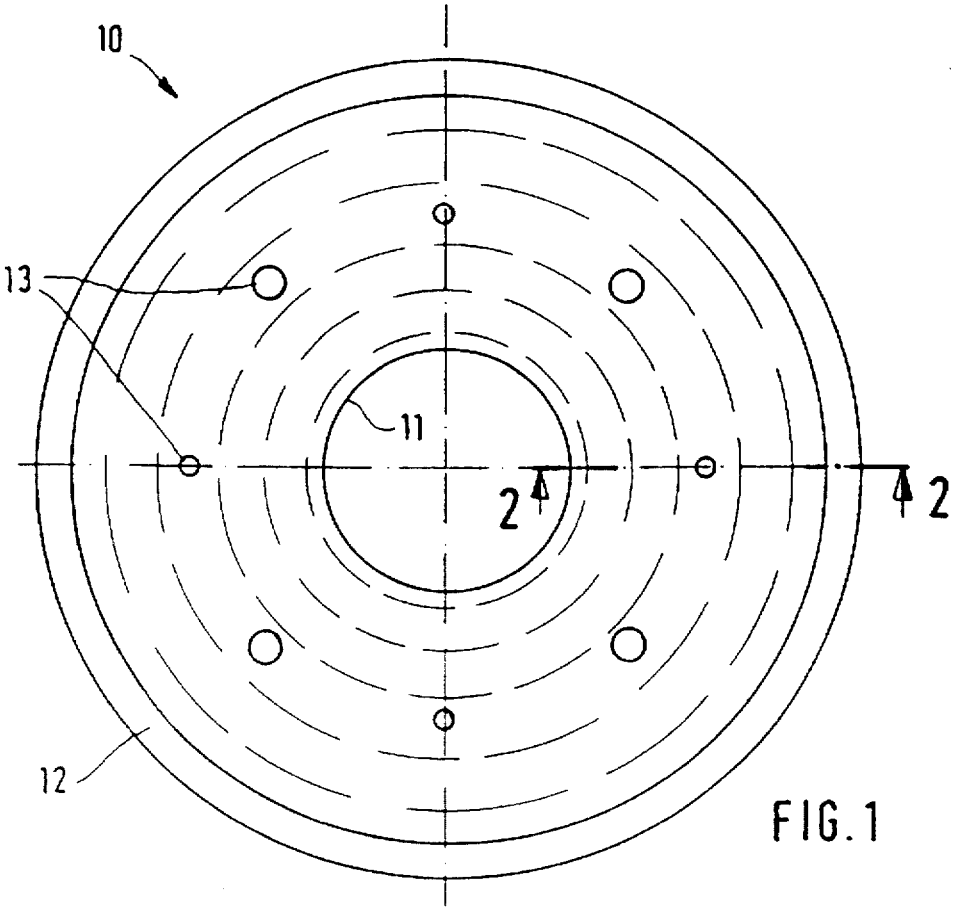
FIG. 1 is a top view of a centering diaphragm.

FIG. 1 shows a top view of a circular centering diaphragm 10, which is made of a copper-beryllium alloy. The inside edge area 11 serves to attach the centering diaphragm 10 to an oscillating component of the loudspeaker (not illustrated in FIG. 1). In the sense of this application, the oscillating components of the loudspeaker include the voice coil, the loudspeaker diaphragm and the voice coil support. The outer edge area 12 of the centering diaphragm 10 is used for connection to the loudspeaker frame (not illustrated in FIG. 1 either).

The centering diaphragm 10 has eight openings 13, which connect the areas before and behind the centering diaphragm with each other, and permit air to be exchanged between the above cited areas. These openings 13, which are symmetrically distributed over the surface of the centering diaphragm 10 with respect to the loudspeaker axis that runs vertical to the paper plane at the intersection point of the center line, have non-uniform cross sections. The configuration of the openings 13 in FIG. 1 is only an example, and can be modified in accordance with the desired stiffness of the centering diaphragm 10.

Figure 2:
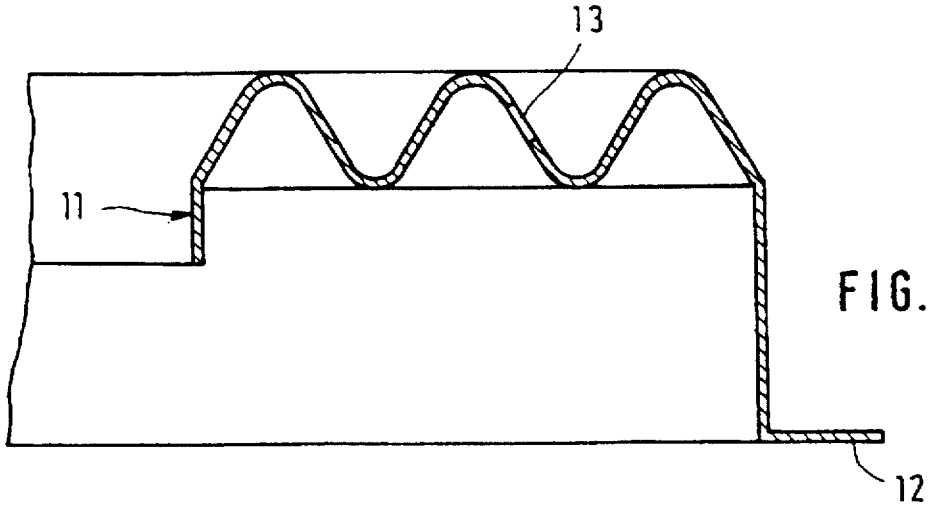
FIG. 2 is a section along A—A according to FIG. 1.

The surface of centering diaphragm 10 has waves, which is indicated by the broken circle lines in FIG. 1, and more clearly in FIG. 2 by a cut along A—A of FIG. 1.

Figure 3:
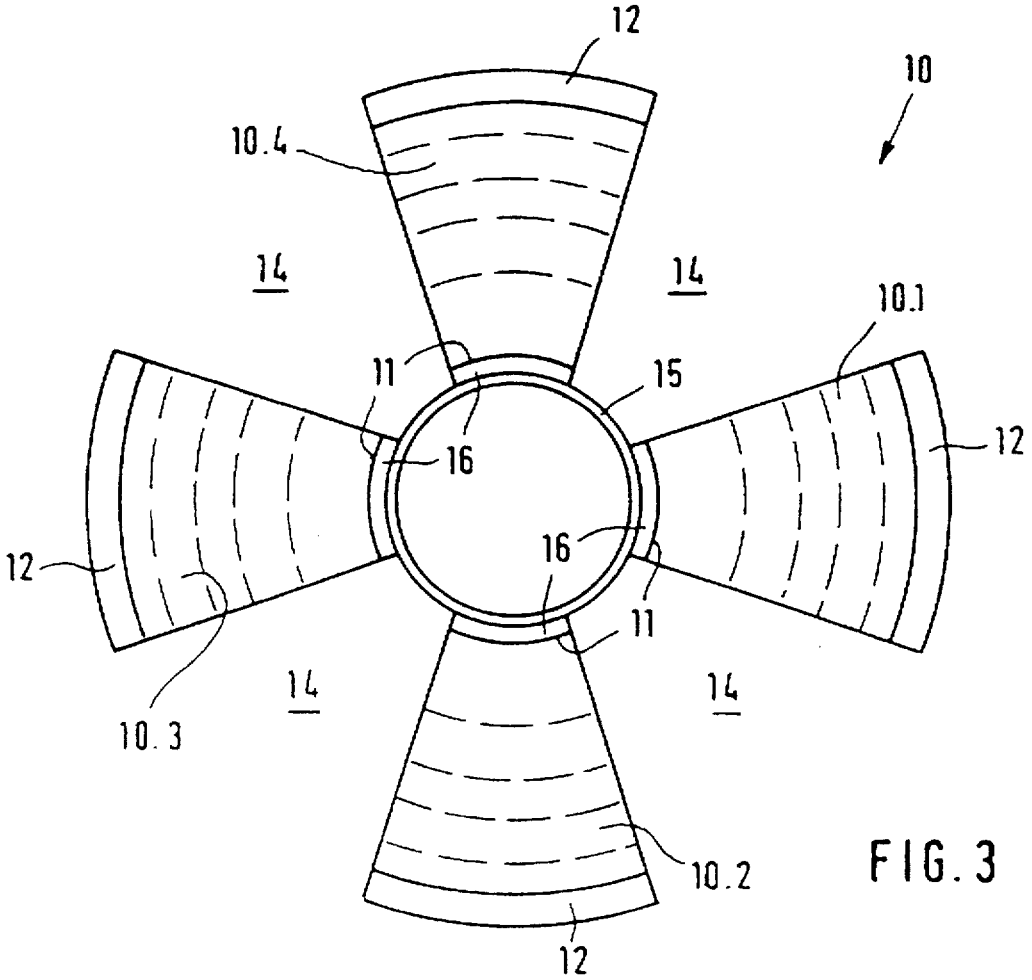
FIG. 3 is a top view of a centering diaphragm.

FIG. 3 is a top view of another centering diaphragm 10. This centering diaphragm 10 consists of four individual components 10.1 to 10.4, where these individual components 10.1 to 10.4 are centered at the loudspeaker axis, which runs vertical to the paper plane at the center line. The individual components 10.1 to 10.4 themselves have no openings 13 of the kind illustrated in FIGS. 1 and 2, but the exchange of air between the areas above and below this centering diaphragm 10 takes place in the free areas 14 adjacent to the individual components 10.1 to 10.4.

The individual components 10.1 to 10.4 are not connected to each other prior to being connected to the tube-shaped voice coil support 15. In the configuration example in FIG. 3, the inside edge areas 11 of all individual components 10.1 to 10.4 are connected to the aluminum voice coil support 15 by interposing an insulation arrangement 16, which will be explained in more detail in conjunction with FIG. 4. Insofar as insulation of the inside edge area 11 is not desired, these edge areas 11 can also be directly connected to the coil support 15. If the surface of the respective individual component 10.1 to 10.4 that contacts the coil support 15 (FIG. 4) is made of aluminum or copper for example, the individual components 10.1 to 10.4 can easily be connected to the aluminum voice coil support 15 by using ultrasonic welding. This does not require that the edge area 11 of the individual component 10.1 to 10.4, which is connected to the voice coil support 15, be entirely made of aluminum or copper. Rather, a thin aluminum or copper coating on the edge area 11 facing the voice coil support 15 is sufficient for ultrasonic welding.

Figure 4:
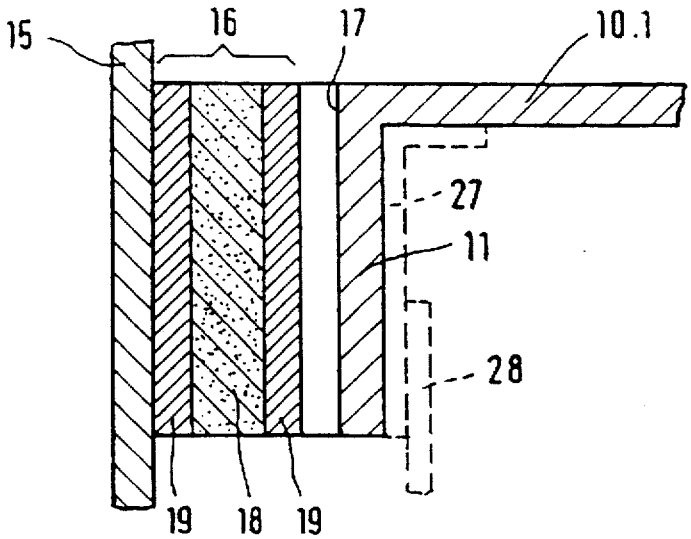
FIG. 4 is a section through the edge area of a centering diaphragm.
Figure 5:
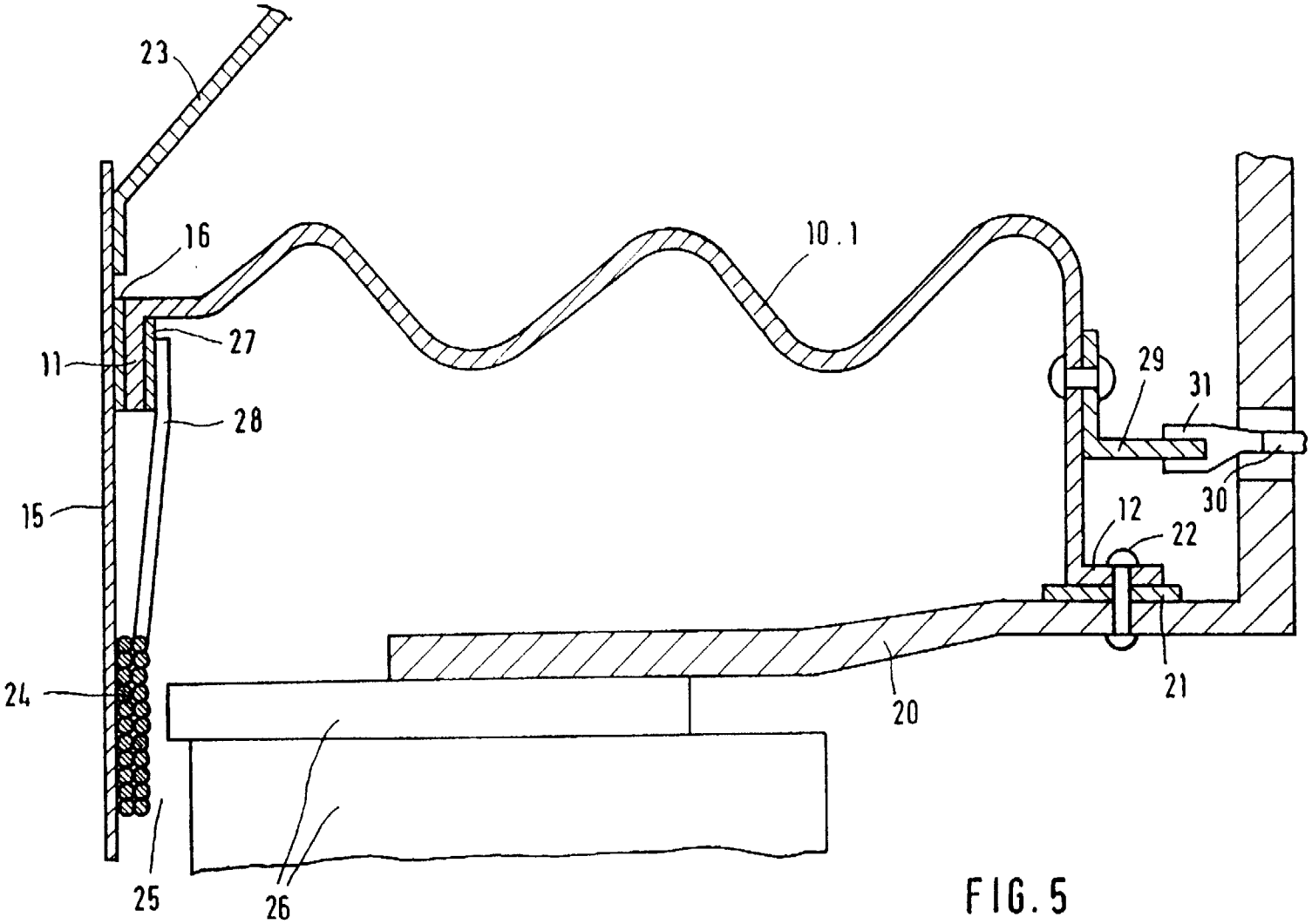
FIG. 5 is a cross section cut through a loudspeaker.

An insulation arrangement 16, as shown in more detail in FIG. 4, is necessary if the inside edge areas 11 of individual components 10.1 to 10.4 are not conductively connected to the voice coil support 15. This insulation arrangement 16 consists of a layer of insulation material 18, whose two surfaces opposing others have a metal coating 19 made of an ultrasonically weldable material. Ceramic was used as the insulation material in the configuration example of FIG. 4. This insulation material is already copper-coated on both sides and can be commercially obtained in this condition. Furthermore, high-temperature-resistant plastics, which can be aluminum plated, are also suitable as insulation material. The use of aluminum, copper or nickel coating on the insulation material has the advantage that the above explained ultrasonic welding technique can also be used on individual components 10.1 to 10.4 which are insulated from the voice coil support 15. Although the use of insulation arrangement 16 was only explained with respect to FIGS. 3 and 4 for the voice coil side of the individual components 10.1 to 10.4, this type of insulated joint can also be used for the outer rim areas 12 of individual components 10.1 to 10.4, as long as it is ensured that the areas of the loudspeaker frame 20 (FIG. 5), with which the outer rim areas 12 will be connected, have surfaces with an ultrasonically weldable metal in the joint area. However, the interposition of insulation arrangements for insulating the outer rim areas 12, explained in conjunction with FIG. 4, is not absolutely necessary, since, in contrast to the edge area 11, the rim area 12 does not require a joint to other components that is especially light from the point of view of weight. This type of attachment of the outer rim area 12, which deviates from the configuration in FIG. 4, is illustrated in FIG. 5. To produce an electrically nonconducting connection between the individual component 10.1 and the loudspeaker frame 20, the outer rim area 12 is connected to the loudspeaker frame 20 by interposing a layer of insulation 21 and a nonconducting attachment device 22. This attachment device 22 passes through the rim 12 of the centering diaphragm 10 or 10.1, the layer of insulation 21 and the loudspeaker frame 20.

Figure 6A:
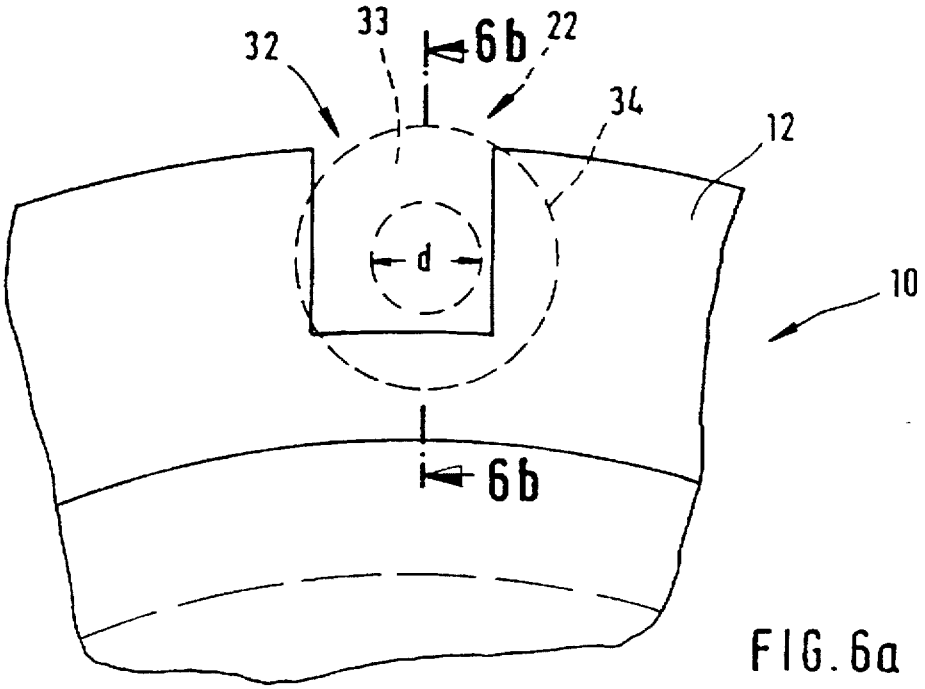
FIGS. 6*a* and 6*b* are each a view of a centering diaphragm.
Figure 6B:
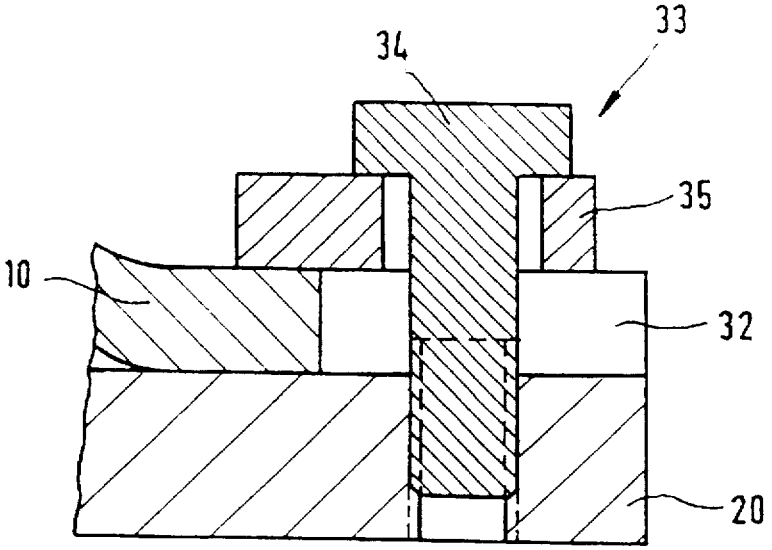

This can be done so that perhaps self-tapping sheet metal screws are used as the attachment device 22, which are screwed into the loudspeaker frame 20 through the rim 12 and the layer of insulation 21, after the centering diaphragm 10 has been aligned and connected to the voice coil support 15. A washer can be inserted between the screw head and the rim, to prevent damage to the rim 12 and to exert sufficient screw head pressure on the rim 12. The creation of the joint with attachment devices 22 is further simplified if self-tapping bolts or rivets are used instead of self-tapping sheet metal screws, which are inserted through holes prepared in the frame 20, the layer of insulation 21 and the rim 12 of the centering diaphragm 10. To be able to perform an alignment of the centering diaphragm 10 or 10.1 with respect to the voice coil support 15, without being restricted by the existing holes, it is essential that the cross sections of the holes in the centering diaphragm 10 or 10.1 be larger than the shaft diameters of the self-tapping bolts or rivets, and smaller than the cross sections of the bolt heads or rivet heads, so that the respective head is always positioned on the rim 12 of the centering diaphragm 10 or 10.1, even if the bolt or rivet shaft is not centered inside the hole. The latter is illustrated in greater detail in FIGS. 6*a* and *b*. FIG. 6*a* shows a cutout of the rim 12 of a centering diaphragm 10. The hole is a pocket-shaped rim cutout 32. The illustration clearly shows that the shaft diameter (d) of the bolt 33 being used as the attachment device 22 is smaller than the cross section of the pocket-shaped rim cutout 32, and that the head 34 of bolt 33 is positioned on the rim 12 in spite of the not centered location of bolt 33 in rim cutout 32. FIG. 6*b* is a side view of cut A—A through the installation situation according to FIG. 6*a*. Different from FIG. 6*a* is that in this case the head 34 of the self-tapping bolt 33 has a smaller diameter. The pressure effect of these bolt heads 34 on the rim 12 is guaranteed by placing a circumferential pressure ring 35 between the rim 12 and the bolt head 34. The loudspeaker frame 20 in the configuration example of FIG. 6*b* is made of plastic, and the layer of insulation 21 depicted in FIG. 5 was therefore omitted.

On the left side of FIG. 5, the inside edge area of individual component 10.1 is joined to the voice coil support 15 in the manner already explained in detail in conjunction with FIG. 4. The loudspeaker diaphragm 23 is located above the joint of voice coil support 15 and individual component 10.1. If for example the loudspeaker diaphragm 23 is made of aluminum, or if its has an aluminum surface on the side facing the voice coil support 15, the loudspeaker diaphragm 23 and the voice coil support 15 can also be joined to each other by using ultrasonic welding. The voice coil 24 is located at the lower end of voice coil support 15. There, voice coil support 15 and voice coil 24 dip into the air gap 25 of magnet system 26. A contact area 27 is formed on the side of inside edge area 11 of the individual component 10.1 that faces away from voice coil support 15, to which one end of a wire 28 from the voice coil 24 leads.

The latter is also indicated by the broken line in FIG. 4. Since the voice coil wire is made of copper, the wire end 28 can very easily be attached by using ultrasonic welding, if the contact area 27 is also made of an ultrasonically weldable metal. The contact of the outside rim area 12 of individual component 10.1 is achieved in such a way, that an angled contact brace 29 is conductively connected to the individual component 10.1. The plug 31 that is connected to one end of the audio signal line 30 pushes over the contact brace 29. If at least two of the individual components depicted in FIG. 5 exist, the voice coil 24 can very easily contact the audio signal line 30 from the signal source (nor illustrated).

Finally, it should be pointed out that the insulation arrangement 16 indicated in FIG. 3 need not necessarily be limited to the areas between voice coil support 15 and the inside edge area 11. Rather, the insulation arrangement 16 can also be circular in a different, not illustrated configuration example. If the individual components 10.1 to 10.4 are used as contact bridges between the voice coil 24 and the audio signal line 30, it is enough if only two of the individual components 10.1 to 10.4 depicted in FIG. 3 have an insulation arrangement 16.

What is claimed is:

1. A centering diaphragm for loudspeakers, wherein the centering diaphragm (10) is made of a nonmagnetic metal, a means is provided to enable the exchange of air between the areas above and below the centering diaphragm (10), the centering diaphragm contains openings (13), wherein at least the surfaces of one of the rim areas (11; 12), by which the centering diaphragm (10) is joined to the other loudspeaker components (15; 20; 23), is made of an ultrasonically weldable metal, and wherein each rim area (11; 12) of centering diaphragm (10) containing such a surface, is joined by ultrasonically welding this surface to another loudspeaker component (15, 20), which also has a surface made of an ultrasonically weldable metal.

2. A centering diaphragm as in claim 1, wherein another loudspeaker component is a voice coil support made entirely of an ultrasonically weldable metal.

3. A centering diaphragm as in claim 1, wherein at least part of the openings (13) subdivide the centering diaphragm (10) into at least two not connected individual components (10.1, 10.2, 10.3, 10.4) which lie within a planar disk formed by the centering diaphragm.

4. A centering diaphragm as in claim 3, wherein at least two of the formed individual components (10.1 to 10.4) have electrically nonconductive connections with the other loudspeaker components (15, 20) through their rim areas (11, 12).

5. A centering diaphragm as in claim 4, wherein at least every insulated individual component (10.1 to 10.4), to insulate at least one side of the two rim areas (11, 12), has a layer of insulation (18) with an ultrasonically weldable metal coating (19) on two opposite surfaces, such that one of these coatings (19) is ultrasonically welded to a rim area (11, 12) of the respective individual component (10.1 to 10.4) which has an ultrasonically weldable surface, while the other respective coating (19) is ultrasonically welded to another loudspeaker component (15, 20), which also has an ultrasonically weldable surface.

6. A centering diaphragm as in claim 4, wherein each wire end (28) from a voice coil (24) located on a voice coil support (15), is conductively connected to an insulated individual component (10.1, 10.2, 10.3, 10.4), and that each individual component (10.1, 10.2, 10.3, 10.4), which makes contact with a wire end (28) from voice coil (24), is conductively connected to one wire end of an audio signal line (30).

7. A centering diaphragm as in claim 6, wherein each individual component (10.1, 10.2, 10.3, 10.4) that makes contact with a wire end (28) from voice coil (24) and the audio signal line (30), has at least one contact area (27) made of an ultrasonically weldable metal, and that at least one wire end (28; 30) is applied to the respective contact area (27) and is conductively connected to the contact area (27) by ultrasonic welding.

8. A centering diaphragm as in claim 1, wherein at least the surfaces of one of the rim areas (11; 12), by which the centering diaphragm (10) is joined to the other loudspeaker components (15; 20; 23), is made of an ultrasonically weldable metal, and that each rim area (11; 12) of centering diaphragm (10) containing a surface, is joined by ultrasonically welding this surface to another loudspeaker component (15, 20), which also has a surface made of an ultrasonically weldable metal.

9. A centering diaphragm as in claim 8, wherein another loudspeaker component is the voice coil support made entirely of an ultrasonically weldable metal.

10. A centering diaphragm as in claim 1, wherein at least part of the openings (13) subdivide the centering diaphragm (10) into at least two not connected individual components (10.1, 10.2, 10.3, 10.4) which lie within a cone formed by the centering diaphragm.

* * * * *